United States Patent [19]

Beattie

[11] 4,023,775

[45] May 17, 1977

[54] APPARATUS FOR RECOVERING ROPE AND CHAIN CABLE

[75] Inventor: David Hepburn Beattie, Wylam, England

[73] Assignee: Clarke Chapman Limited, Tyne and Wear, England

[22] Filed: July 10, 1975

[21] Appl. No.: 594,931

[30] Foreign Application Priority Data

Aug. 8, 1974 United Kingdom ..... 35101/74

[52] U.S. Cl. ..... 254/190 R; 254/175.7; 114/254

[51] Int. Cl.² ..... B66D 1/36

[58] Field of Search ..... 254/168, 167, 135 R, 254/190 R, 174, 175.7, 175.5; 114/235 R, 235 A

[56] References Cited

UNITED STATES PATENTS

| | | | |
|---|---|---|---|
| 2,519,400 | 8/1950 | Robins et al. | 254/167 |
| 2,894,610 | 7/1959 | Harrington | 254/167 |
| 3,163,399 | 12/1964 | Skerry | 254/167 |
| 3,300,187 | 1/1967 | Saxe et al. | 254/175.7 |
| 3,448,962 | 6/1969 | Miller | 254/175.7 |
| 3,583,354 | 6/1971 | Flickinger | 254/175.7 |
| 3,912,228 | 10/1975 | Petty et al. | 254/175.7 |

*Primary Examiner*—Albert J. Makay
*Assistant Examiner*—Kenneth Noland

[57] ABSTRACT

A rope connected to a chain cable by a connector is recovered using a chain cable lifter wheel. The connector is shaped to pass over the wheel, which has a groove for the rope. The wheel has pockets which can receive the connector and also receive chain cable links. Protuberances on the connector and stops in the pockets ensure correct seating of the connector in a pocket so as to ensure correct subsequent engagement of chain links with the pockets of the wheel.

11 Claims, 7 Drawing Figures

APPARATUS FOR RECOVERING ROPE AND CHAIN CABLE

BRIEF SUMMARY OF THE INVENTION

An object of the invention is to provide apparatus by which a rope and chain cable ligament can be recovered and payed out using a lifter wheel. The apparatus includes in combination a rope connected to a chain cable by a connector and a lifter wheel having pockets to receive the connector and links of the chain cable and a groove to receive the rope.

The invention enables a rope and chain cable assembly to be recovered or payed out using a common lifter wheel.

The invention enables the rope to be connected to the chain cable by a connector which is capable of passing over the wheel accommodated in a pocket therein and which is capable of correctly engaging with the wheel regardless of the angular orientation of the connector (about a lengthwise axis) as the connector approaches the wheel in recovery of rope and chain cable. The correct engagement of the connector with the wheel ensures correct subsequent engagement between the chain cable and the wheel.

The invention also minimises bending of the rope adjacent the connector, so that the risk of damage or reduction of strength of the rope is avoided or is at least rendered negligible.

BACKGROUND OF THE INVENTION

The invention relates to apparatus by which rope and chain cable may be recovered or payed out.

A typical, though not the only, example of use of the invention is on marine oil drilling rigs and platforms where heavy-duty chain cable used for anchoring the rig or platform is connected to heavy-duty rope and both rope and cable have to be recovered or payed out.

It is known to recover and pay out chain cable using a chain-cable lifter wheel having pockets to receive chain links. Such cable lifter mechanism is used on ships for handling anchor chain. Since very heavy chains are needed for oil drilling rigs or very large ships it is advantageous to use chain cable only for a part of the length of the anchoring element and to use wire or other rope for the remainder. The recovery and paying out of chain cable and rope is required to be performed quickly and safely often under difficult conditions caused by weather and sea conditions. The applicants are not aware that the recovery of a ligament made up of a rope and cable has been achieved using a common lifter wheel, prior to the Applicant's invention.

A particular problem which is overcome by the invention is the provision of a connector which connects the rope to the chain cable but which is compact enough to fit into a pocket on the wheel and which is capable of correct seating on the wheel so as to ensure correct subsequent engagement between the chain cable and the wheel.

BRIEF DESCRIPTION OF THE DRAWINGS

One form of apparatus will now be described by way of example to illustrate the invention with reference to the accompanying drawings, in which.

DETAILED DESCRIPTION

Figure 1:
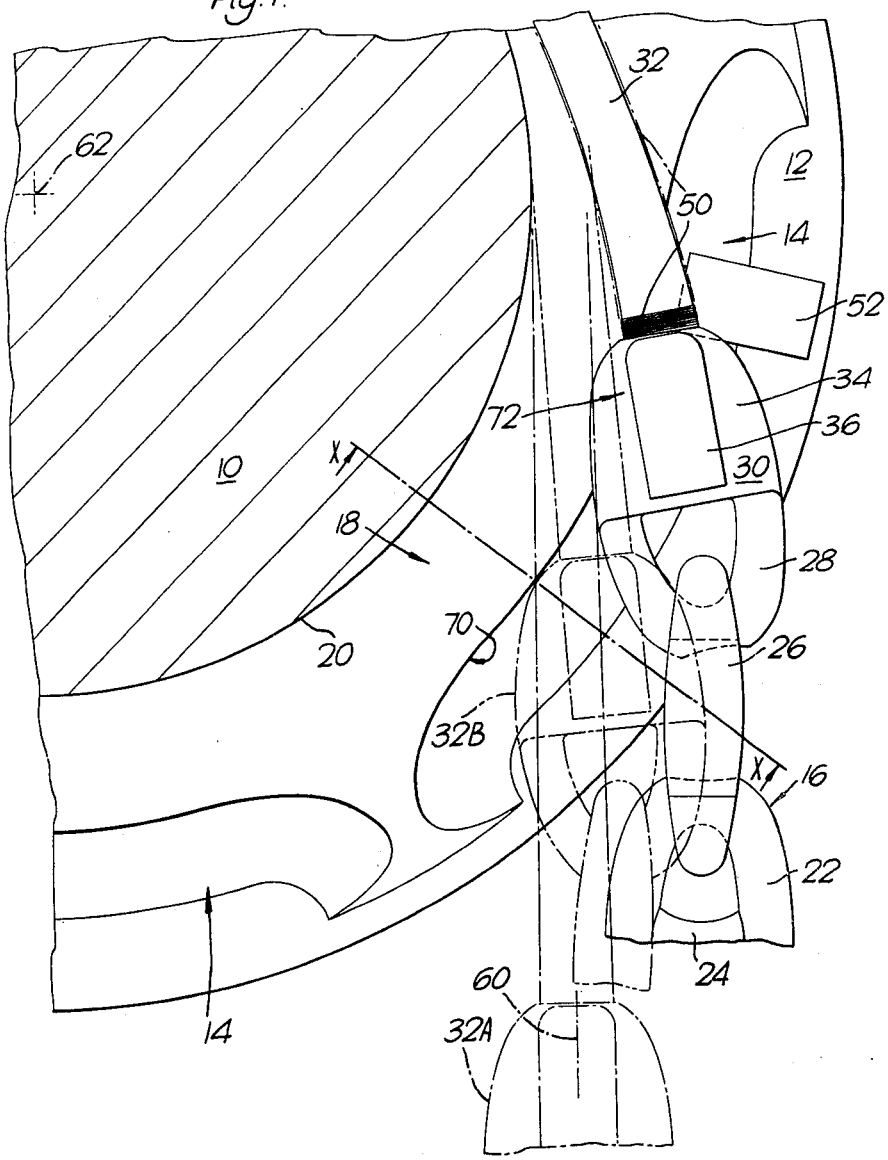
FIG. 1 is a diagrammatic vertical central section transverse to the axis of rotation of a cable lifter wheel forming part of apparatus for recovering a rope and chain cable which are shown in successive positions as the connector and chain-cable approach the wheel during recovery, the connector being in a first orientation.

FIG. 1 shows a cable lifter wheel 10 having two spaced flanges 12 having inner opposed profiled faces so as to define five pockets 14 each shaped so as to accommodate and hold links of a chain cable 16. The flanges 12 radially inwardly of the pockets 14 define between them a groove 18, and the flanges 12 merge together to provide a base surface 20 to the groove 18.

The chain cable comprises links 22 each having a bridging stud 24. The links 22 are joined by a two-part link 26 (the parts of which can be separated to allow disconnection of the cable) to a semi-link portion 28 of a connector 30. The connector 30 joins the chain cable 16 to a steel wire strand rope 32, which is shown accommodated in the groove 18 and passing over the top of the wheel 10.

Figure 5:
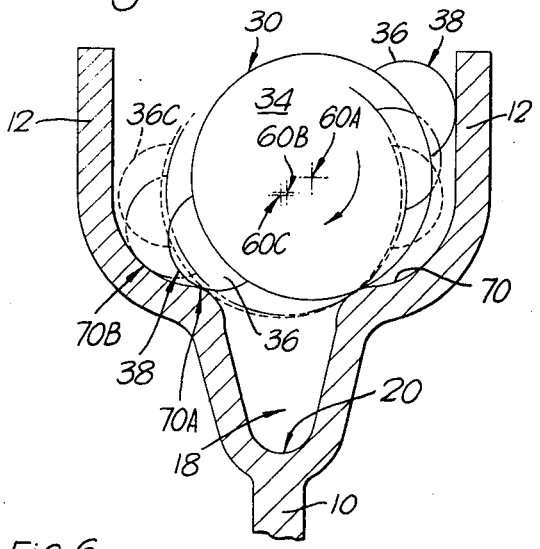
FIGS. 5 and 6 are diagrammatic radial sections through the part of a wheel on the line X—X in FIG. 1 and also through the connector showing successive positions of the connector as it moves from an initial position intermediate the first and second orientations to the first orientation and to the second orientation respectively.
Figure 6:
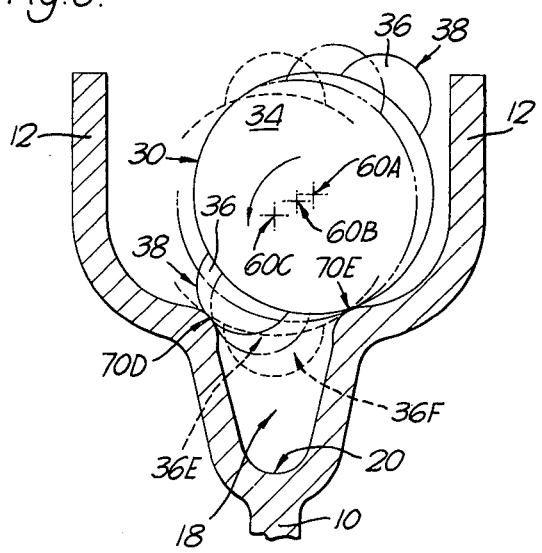

The connector 30 includes a half-ovoid shaped body 43 which has two laterally extending protuberances 36 which are symmetrically located on opposite sides of the body 34. Each protuberance 36 has a generally semi-cylindrical lengthwise edge surface 38 (FIGS. 5 and 6). The length of the connector 30 is equal to the length of a link 22 and the width and shape of the connector 30 as shown in FIG. 1 is the same as the width and shape of a link 22.

Figure 2:
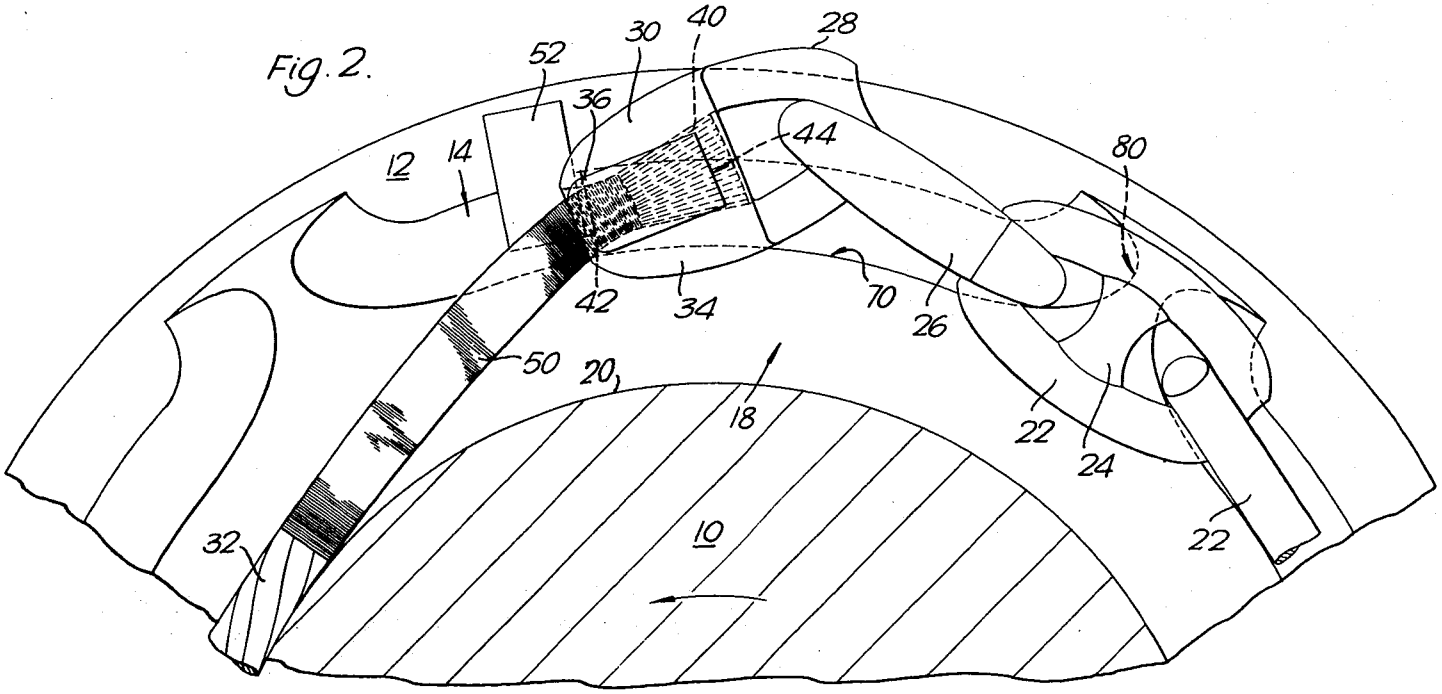
FIG. 2 is a diagrammatic section similar to that in FIG. 1 but showing the wheel after engagement of the connector with the wheel and after some 90° of anti-clockwise rotation of the wheel from the position shown in FIG. 1.

The connector 30 has a front end aperture (FIG. 2) which receives an end portion of the rope 32. The aperature is tapered as shown in FIG. 2 at 40 towards the front end and then diverges at 42. The rope 32 is anchored in the aperture by anchorage material such as cast white metal 44 which extends as far as the throat in the aperture between the parts 40 and 42. The rope 32 is free to flex beyond the throat within the divergent part 42, the wall of which is convex to give support to the rope 32 when it is flexed as shown in FIG. 2. The rope 32 has a layer of wire whipping 50 to give further support to the rope 32 during flexing.

Each pocket 14 contains stop means in the form of two opposed stop blocks 52 each secured to a respective flange 12 and extending inwardly across the pocket towards the other.

The wheel 10 is part of a large combined winch and cable lifter mechanism. Drive can be clutched in to turn the wheel 10 or the winch drum at will and brakes for the winch drum and wheel 10 are provided. The apparatus is suitable for use as one of several mooring equipments on a very large marine or drilling rig or platform. The chain cable 16 is very heavy and in use is lowered onto the seabed to anchor the rig. The use of rope reduces the total weight of ligament used to anchor the rig and the rope is wound on the winch drum. Thus, when the chain cable is lifted by the wheel 10 and passes downwardly it can form a pile in a chain cable locker, the winch drum then being unoperative. In the description below of the operation of the wheel in recovering the chain cable it is assumed that the invention is applied to the mooring of such a marine rig or platform, but the invention is of wider application and can be used in other analogous situations.

Figure 7:
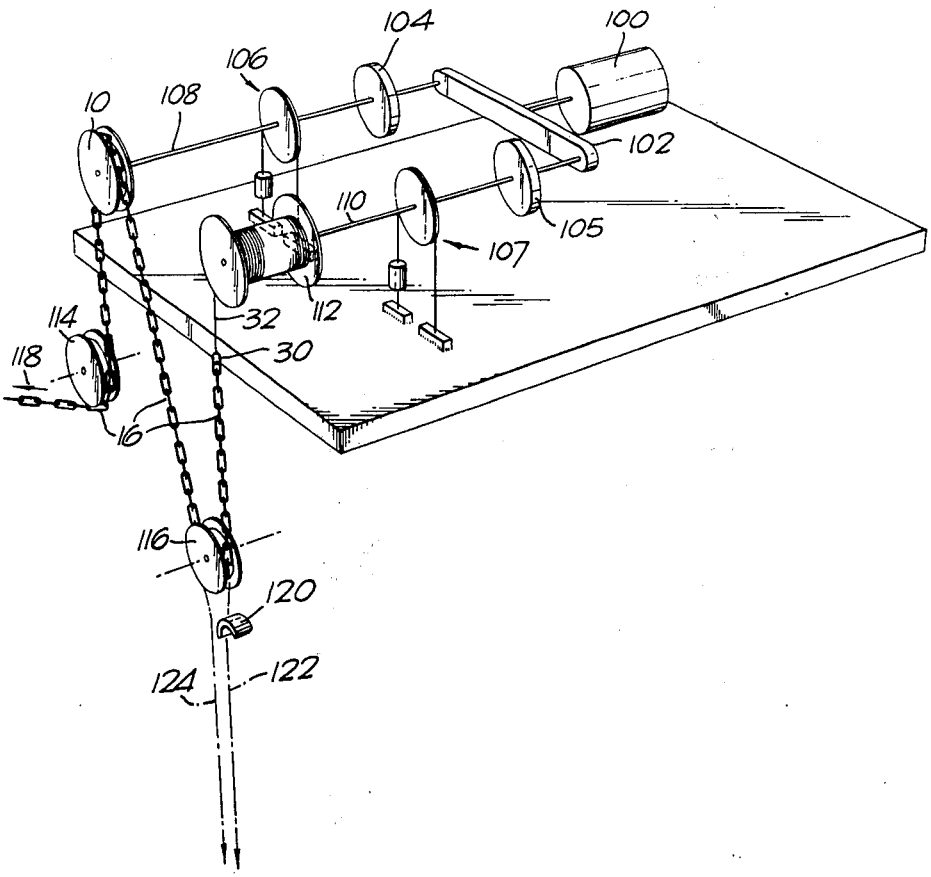
FIG. 7 is a diagrammatic three-dimensional view of the apparatus as a whole combining the lifter wheel, rope connector and chain-cable in FIGS. 1 to 6.

FIG. 7 shows a typical arrangement of apparatus for a large marine vessel or structure such as a drilling rig or platform.

The winch comprises a reversible motor 100 having an output shaft driving transfer gearing in a casing 102. Output shafts from the gearing in the casing 102 each have a clutch mechanism 104 or 105 and output shafts from the clutch mechanism 104 each have a band brake 106 or 107. The output shafts 108, 110 from the clutch mechanism 104 carry, respectively, the wheel 10 and a winch drum 112.

The rope 32 and chain-cable 16 comprises the ligament are shown arranged for passage around a fairlead wheel 114 and a return pulley wheel 116. The chain-cable links are only partly shown but they continue beyond the end link as shown at the arrow 118 to the sea bed when the ligament is in use to anchor the vessel or structure. The rope 32 is shown wound around the barrel of the winch drum 112.

A fixed guide 120 is shown adjacent the pulley wheel 116. The guide 120 slightly deflects the pendant chain-cable 16 as indicated at 122 after recovery of chain cable from the seabed as described below. The chain-cable 16 then also depends as shown at 124 from the wheel 10. The downwardly extending passes of chain-cable represented at 122 and 124 form parts of a loop of chain-cable which extend down into a chain locker (not shown). The guide 120 also assists return of the chain-cable 16 into correct engagement with the pulley wheel 116 when chain-cable is payed out from the locker so as to return the chain-cable to the arrangement shown in FIG. 7.

OPERATION

To recover the rope 32 and the chain-cable 16, the brakes 106 and 107 are released, the clutch 104 is released and the clutch 105 is engaged. The winch motor 100 is energised to haul in the rope 32, which rubs over the wheel 10, which is free running and disengaged from its drive. The rope 32 runs in the groove 18. When the connector 30 reaches a position approaching that shown at 32A in FIG. 1 it is necessary for the operator to observe the angular orientation of the connector about an axis lengthwise of the connector, say the axis 60. The connector 30 must be brought into proper engagement with the wheel 10 and, while it is possible that the connector can be seen to be positioned for such proper engagment as the wheel 10 continues to turn, in most cases it will not be possible to decide that that is the case.

In most cases, therefore, it is preferred to engage the brake 106 (FIG. 7) of the wheel 10, so as to stop the wheel 10 in a position such that a set of stop blocks 52 occupies the angular position shown while the connector 32 is in an approach position 32A clear of the wheel 10. The winch motor 100 is kept energised to keep the drum 112 hauling slowly and the rope 32 now slides on the base surface 20 of the groove 18.

In FIG. 1 it is assumed that next to the connector 32 reaches the position 32B and engages the wheel 10 in a first angular orientation about the axis 60 such that the protuberances 36 lie in a plane parallel to the axis 62 of rotation of the wheel 10.

In that position, the body 34 symmetrically engages at opposite sides with the edges of shoulders 70 being part of the profiled pocket 14 in which the stop blocks 52 lie.

Further recovery of the rope 32 causes the connector 30 to slide along the edges of the shoulders 70 until it reaches the position shown in full lines in FIG. 1. In that position the connector 30 engages the stop blocks 52 and the body 34 of the connector has moved slightly inwardly radially because the edges of the shoulders 70 are relieved slightly generally as indicated at 72, though it is not possible to show this fully in the sections used. This position of the connector 30 minimises bending of the rope 32 adjacent the connector 30.

Figure 3:
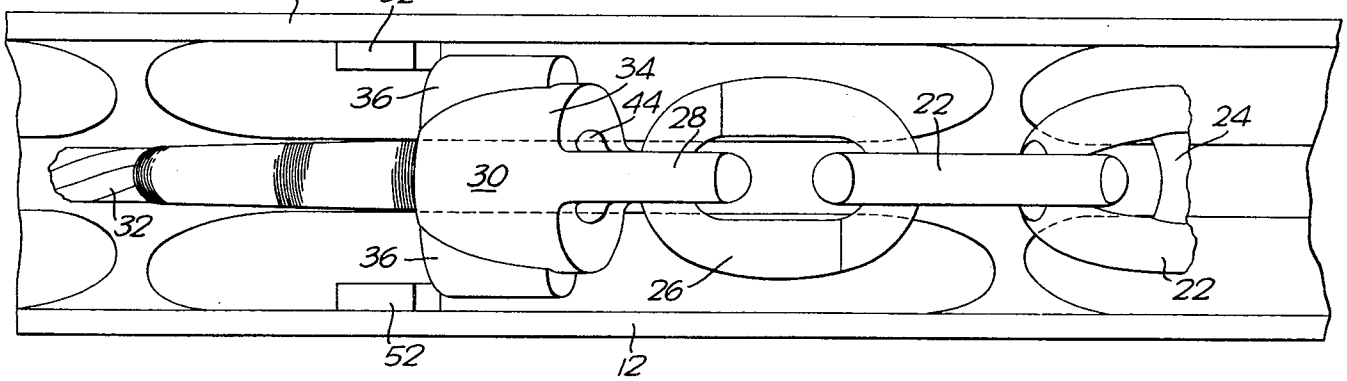
FIG. 3 is a diagrammatic plan of the parts shown in FIG. 2.

The brake 106 on the wheel 10 is then released and the winch drum 112 is driven further to recover the rope 32 and to draw the chain-cable 16 further over the wheel 10. FIGS. 2 and 3 show the position after a further 90° of anti-clockwise rotation of the wheel 10 from the position shown in FIG. 1.

The wheel 10 can now be driven by engagement of the clutch 104. The wheel 10 would turn slightly relative to the chain cable 16 so that the trailing end surfaces 80 of the pocket 14, in which the connector 30 lies, engage the rear end of the first link 26 of the chain cable 16 and thereafter the wheel 10 can lift the chain cable 16. If preferred, the chain-cable can be recovered further, so that a length hangs down from the left hand side of the wheel 10 as viewed in FIG. 2, by hauling of the rope 32 before the drive to the wheel 10 is engaged. In that case a later link 22 would be engaged by trailing end surfaces 80 of a pocket 14 to lift the chain-cable.

Had the connector approached the wheel 10 in a second orientation angularly displayed 90° from that shown in FIG. 1, the wheel 10 would have braked in the same angular position but recovery of the rope 32 would have caused the connector protuberance 36 nearest to the wheel 10 to enter the groove 18. The connector 30 would have slid on edges of the shoulders 70 as before but, since the gap between the stop blocks 52 is wider than the body 34 of the connector, the latter would have slid past the stop blocks into engagement with the flanks of the other end surfaces 90 of the pocket 14, as shown in FIG. 4.

Figure 4:
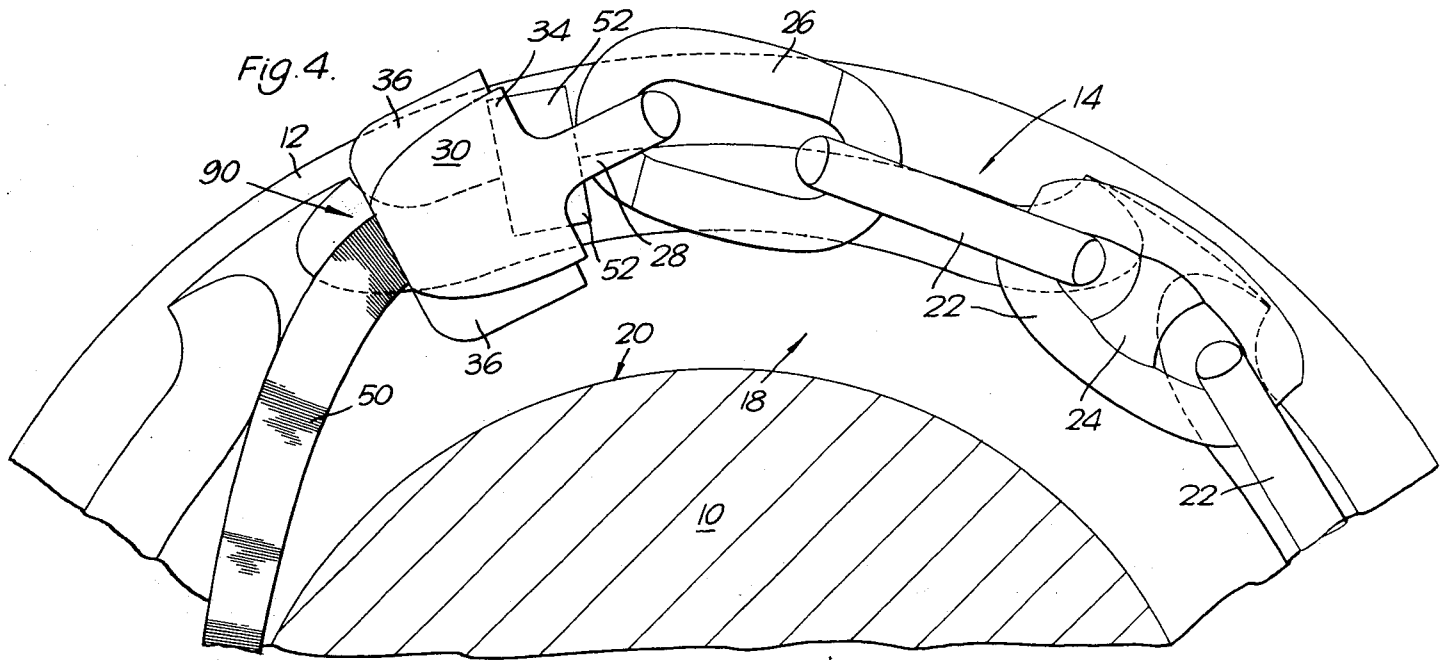
FIG. 4 is a diagrammatic section similar to that shown in FIG. 2 but showing the connector in a second orientation displaced 90° from the first orientation shown in FIG. 2.

In the position shown in FIG. 4, when drive is applied to the wheel 10, the chain-cable 16 would be lifted by engagement between links 22 and the trailing end surfaces 80 of a pocket 14, as before.

FIG. 5 shows the connector 30 in full lines at the point of engagement with the wheel 10 in an angular orientation intermediate the first and second orientations referred to above. A lower protuberance 36 engages a left shoulder at 70A and the other engages the upper inner surface of the flange 12 at the right hand side of the pocket. The connector body 34 engages the edge of the right hand shoulder 70. As the rope 32 is recovered while the wheel 10 is braked, the connector slides further past the wheel 10 and two further successive positions are shown by broken lines during that sliding movement. The connector 30 changes its angular orientation clockwise as indicated by the arrow about the axis 60 and that axis moves parallel to itself from the position 60A corresponding to the connector position shown by full lines to the position 60B. The lower protuberance slides outwardly to a point of contact 70B on the shoulder 70 and eventually moves clear of the shoulder 70 to the position 36C, after which the protuberances 36 engage the stop blocks 52 as described with reference to FIGS. 2 and 3. It would be possible for the other protuberance to engage the opposite shoulder 70, in which case the connector would change its angular orientation in similar manner but in anticlockwise sense.

FIG. 6 shown the connector 30 in full lines at the point of engagement with the wheel 10 in an angular orientation intermediate the first and second orientations referred to above. A lower protuberance 36 engages the edge surface of the left hand shoulder 70 at 70D and the body 34 engages the edge surface of the right hand shoulder 70 at 70E. The axis 60 is at 60A. As the rope is recovered the axis 60 moves from 60A to 60B and to 60C. The connector changes its angular orientation about the axis 60 in anti-clockwise sense, the lower protuberance sliding down off the edge of the shoulder 70 to positions 36E and 36F in which the protuberance is 36 well within the groove 18.

After that the connector 30 slides further past the wheel 10 as described with reference to FIG. 4.

A similar change of orientation could occur were the connector 30 to engage the wheel initially with a lower protuberance 36 engaging the edge of the right hand shoulder 70, but in a clockwise sense.

After the chain-cable 16 has been properly engaged with the wheel 10 and the drive to that wheel, the wheel 10 and the winch drum 112 are both driven so that the rope 32 is wound up on the drum 112 so far as the position shown in FIG. 7, in which almost all the rope is on the drum. The drum is then held by engagement of the brake 107 and disengagement of the clutch 105. The wheel 10 is still driven to recover the chain-cable 16, which now runs down from the wheel 10 in a deepening loop into the chain locker already mentioned. The chain-cable piles up in the locker. The two passes of chain-cable 122, 124 are passed down to the pile. The brake 106 is finally applied and the clutch 104 disengaged. The rope and chain-cable are thus fully recovered and stowed.

To pay out rope and cable, the reverse procedure is adopted. The clutch 104 is engaged, the brake 106 released and the wheel 10 dirven in the opposite sense to pay out chain-cable 16 which the wheel 10 lifts from the chain-cable locker. Eventually the chain-cable returns into engagement with the pulley wheel 116 as shown in FIG. 7. Thereafter the brake 107 is released to allow rope to run off the winch drum 112. Drive may be applied to the drum 112 by engagement of the clutch 105 if desired.

I claim:

1. In combination, a chain-cable lifter wheel, means for driving said chain-cable lifter wheel, ligament means comprising a chain-cable made up of a plurality of interconnected links, a rope, and a connector connecting an end link of said chain cable to a first end of said rope, a drum which receives a second end of said rope, and means for driving said drum, said lifter wheel having first formations which define a circularly-disposed series of pockets and said lifter wheel having second formations which define an annular groove, said first formations being shaped to enable each said pocket to accommodate a link of said chain-cable, said second formations being shaped to enable said groove to accommodate said rope, said connector being shaped so as to be capable of being accommodated in any of said pockets and having elements of shape thereon, said first formations including means cooperable with said elements of shape in a first angular orientation of said connector about a lengthwise axis thereof to stop said connector moving relative to said wheel circumferentially thereof beyond first position, said means being cooperable with said elements of shape in second angular orientation of said connector angularly displaced 90° about said axis from said first orientation to allow said connector to move relative to said wheel circumferentially thereof beyond said first position, whereby relative movement between said connector and said wheel ensures seating of said connector in any one of said pockets and ensures a relationship between said connector and said wheel such that said links of said chain-cable correctly enter said pockets.

2. The combination claimed in claim 1, in which said elements of shape comprise two protuberances one on either side of said connector.

3. The combination claimed in claim 2, in which each said protuberance is configured so as to be capable of being accommodated in said groove.

4. The combination claimed in claim 1, in which said connector comprises a half-ovoid shaped body and said elements of shape comprise two protuberances one on either side of said connector symmetrically positioned with respect to said body, each said protuberance having a generally semi-cylindrical lengthwise edge surface.

5. The combination claimed in claim 4, in which the length of said connector is equal to the length of each said link of said chain-cable.

6. The combination claimed in claim 4, in which the outline width and shape of said connector is generally the same as the width and shape of each link of said chain-cable.

7. The combination claimed in claim 1, in which said pockets total five.

8. The combination claimed in claim 1, in which each said pocket is enough to accommodate three of said links of said chain-cable.

9. In combination, a chain-cable lifter wheel, means for driving chain-cable lifter wheel, ligament means comprising a chain-cable made up of a plurality of interconnected links, a rope, and a connector connecting an end link of said chain cable to a first end of said rope, a drum which receives a second end of said rope, and means for driving said drum, said lifter wheel having first formations which define circularly-disposed series of pockets and said lifter wheel having second formations which define an annular groove, said first formations being shaped to enable each said pocket to accommodate a link of said chain-cable, said first formations including at each said pocket two stop blocks, each stop block extending across said pocket towards the other stop block so as to define a gap therebetween, said second formations being shaped to enable said groove to accommodate said rope, said connector being shaped so as to be capable of being accommodated in any of said pockets and having elements of shape comprising two protuberances one on either side of said connector, said connector and said protuberances being such that, in a first orientation of said connector about a lengthwise axis thereof, said relative movement between said connector and said wheel results in engagement between said protuberances and respective stop blocks after which further movement of said connector circumferentially relative to said lifter wheel is prevented, and, in a second orientation of said connector angularly displaced 90° about said axis from said first orientation, said relative movement results in entry of one or other of said protuberances into said groove and includes movement of said connector past said stop blocks, said relative movement terminating when said connector engages end surfaces of said first formations, whereby relative movement between said connector and said wheel ensures seating of said connector in any one of said pockets and ensures a relationship between said connector and said wheel such that said links of said chain-cable correctly enter said pockets.

10. In combination, a chain-cable lifter wheel, means for driving said chain-cable lifter wheel, ligament means comprising a chain-cable made up of a plurality of interconnected links, a rope, and a connector connecting an end link of said chain cable to a first end of said rope and having an overall length of the same order as the length of a single one of said links, a drum which receives a second end of said rope, and means for driving said drum, said lifter wheel having first formations which define a circularly-disposed series of pockets and said lifter wheel having second formations which define an annular groove, said first formations being shaped to enable each said pocket to accommodate a link of said chain-cable, said second formations being shaped to enable said groove to accommodate said rope, said connector being shaped so as to be capable of being accommodated in any of said pockets and having thereon means cooperable with said first formations upon relative movement between said connector and said wheel to cause seating of said connector in any one of said pockets and cause orientation of said connector and said wheel such that said links of said chain-cable correctly enter said pockets.

11. In combination, a chain-cable lifter wheel, means for driving said chain-cable lifter wheel, ligament means comprising a chain-cable made up of a plurality of interconnected links, a rope, and a connector connecting an end link of said chain cable to a first end of said rope, a drum which receives a second end of said rope, and means for driving said drum, said lifter wheel having first formations which define a circularly-disposed series of pockets and said lifter wheel having second formations which define an annular groove, said first formations being shaped to enable each said pocket to accommodate a link of said chain-cable, said second formations being shaped to enable said groove to accommodate said rope, said connector being shaped so as to be capable of being accommodated in any of said pockets and having elements of shape cooperable with said first formations whereby relative movement between said connector and said wheel ensures seating of said connector in any one of said pockets and ensures a relationship between said connector and said wheel such that said links of said chain-cable correctly enter said pockets, said first formations including means cooperable with said elements of shape in a first angular orientation of said connector about a lengthwise axis thereof to stop said connector moving relative to said wheel circumferentially thereof beyond a first position, said last-named means being cooperable with said elements of shape in a second angular orientation of said connector angularly displaced 90° about said axis from said first orientation to allow said connector to move relative to said wheel circumferentially thereof beyond said first position.

* * * * *